US006227909B1

(12) United States Patent
Lai

(10) Patent No.: US 6,227,909 B1
(45) Date of Patent: May 8, 2001

(54) CABLE CONNECTOR WITH IMPROVED GROUNDING ARRANGEMENT

(75) Inventor: Chin-Te Lai, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/377,668

(22) Filed: Aug. 19, 1999

(30) Foreign Application Priority Data

Dec. 18, 1998 (TW) ..... 87221141

(51) Int. Cl.[7] ..... H01R 13/648
(52) U.S. Cl. ..... 439/607; 439/701
(58) Field of Search ..... 439/607–610, 439/701

(56) References Cited

U.S. PATENT DOCUMENTS 4,521,062 * 6/1985 Kurbikoff et al. ..... 439/607
5,137,472 * 8/1992 Hillbish et al. ..... 439/607
5,637,015 * 6/1997 Tan et al. ..... 439/607

* cited by examiner

*Primary Examiner*—Khiem Nguyen
(74) *Attorney, Agent, or Firm*—Wei Te Chung

(57) ABSTRACT

A cable connector with improved grounding arrangement for electrically connecting to a shielded cable comprises a dielectric housing receiving a number of contacts therein, a shielding mechanism consisting of a first shell and a second shell, a module including a circuit board, and a dielectric shell enclosing the cable connector. The housing forms a frame comprising a pair of step-like shoulders and a pair of diagonal faces. The first and second shells form a pair of first and second grounding tabs, respectively, for engaging with the corresponding shoulders of the housing. The first grounding tabs overlap on the corresponding second grounding tabs thereby forming a grounding path through grounding wires of the cable terminated to the cable connector, the second shell, the first shell and a shield of a mating connector therethrough. The first shell also has a pair of positioning tabs extending from middle portions of edges of upper and lower surfaces thereof. Each positioning tab defines a latching aperture therein for securing corresponding projection formed on the housing. Therefore, the shielding mechanism provides the cable connector with reliable grounding capabilities when the cable connector undergoes a bending test due to the provision of middle cutouts of the second shell and the middle grounding tabs of the first shell.

5 Claims, 6 Drawing Sheets

CABLE CONNECTOR WITH IMPROVED GROUNDING ARRANGEMENT

BACKGROUND OF THE INVENTION

The present invention relates to a cable connector, and particularly to a cable connector with improved grounding arrangement for electrically engaging with a shielded cable.

Signal transmission of a conventional cable connector is often disrupted by electromagnetic interference. Conventional cable connectors usually have a grounding or shielding mechanism for providing protection from electromagnetic interference. Pertinent examples are disclosed in Taiwan Patent Application Nos. 82101300, 821109498 and 83200965.

Referring to FIGS. 1 and 2, a shielding mechanism of a conventional cable connector comprises a first shell 3' and a second shell 4'. The first shell 3' forms two pairs of latching tabs 32' on opposite edges thereof. Each latching tab 32' defines an aperture therein for engaging with corresponding first projections 16' formed on a dielectric housing 1' thereby fixing the first shell 3' to the housing 1'. The second shell 4' forms positioning plates 43' on opposite edges thereof. Each positioning plate 43' defines an opening 430' therein for engaging with a second projection 16" formed on the housing 1'. A pair of side wings 44' outwardly extend from the housing 1'. A hole 441' is formed in each side wing 44' for cooperating with the housing 1'. A joining portion 431' is formed between the positioning plate 43' and a main body of the second shell 4'. When the first and second shells 3', 4' are fixed to the housing 1', the positioning plate 43' will overlap on a middle portion between the latching tabs 32' of the first shell 3'. Thus, a grounding path is formed via grounding wires of a cable terminated to the cable connector, the second shell 4', the first shell 3', and a shield of a mating connector for electrostatic discharges therethrough.

However, when the cable connector is undergoing a bending test, a vibrating test or is bent optionally in applications, the positioning plate 43' will break easily at the joining portion 431' as a large quantity of internal stress of the second shell 4' itself are inevitably concentrated thereon. Thus, the grounding path will form open circuit or break off thereby decreasing the shielding effect of the shielding mechanism and adversely affecting signal transmission reliability.

After the dielectric housing 1' is assembled with the other components to form a subassembly, the second projections 16" can not move within the elongate aperture 430' of the position plate 43'. Thus, the main body of the second shell 4' as well as the first shell 3' may easily buckle at middle portion thereof. Thus, when a dielectric shell is insert molded around the subassembly, the dielectric shell will also become damaged due to the buckling of the shielding mechanism resulting in a defective cable connector.

BRIEF SUMMARY OF THE INVENTION

A main object of the present invention is to provide a cable connector having a shielding mechanism for ensuring a reliable signal transmission therethrough.

Another object of the present invention is to provide a cable connector having a shielding mechanism which can endure frequent bending movements thereby ensuring a reliable performance of the cable connector.

A cable connector in accordance with one aspect of the present invention comprises a dielectric housing receiving a plurality of contacts therein and a shielding mechanism including a first shell and a second shell. The first shell forms a pair of positioning tabs extending from middle portions of edges of upper and lower surfaces thereof, respectively. The second shell defines a pair of cutouts in edges of middle portions of upper and lower surfaces thereof corresponding to the positioning tabs of the first shell. The first and second shells form a pair of first and second grounding tabs on opposite lateral sides thereof for abutting against outer surfaces of a positioning portion of the dielectric housing. Each second grounding tab of the second shell forms an outwardly projecting dimple for engaging with the corresponding first grounding tab of the first shell. Thus, a grounding path is established through grounding wires of a cable terminated to the cable connector, the second shell, the first shell, and a shield of a mating connector for electrostatic discharges therethrough. When the cable connector is bent optionally in applications or in a bend (vibrating) test, the grounding path will not break off or become open circuit since disengagement between the first and second grounding tabs of the first and second will not occur after the dielectric jacket is assembled to achieve the cable connector.

The first and second grounding tabs are formed on opposite lateral edges of the first and second shells and assembled to the corresponding shoulders of the housing, moreover, a pair of cutout is defined in middle of the second shell responding to the positioning tabs of the first shell. Therefore, middle portions of the second shell will not buckle, thus, the dielectric jacket will have an excellent configuration after being insert molded around a subassembly consisting of the housing and the shielding mechanism.

Other objects, advantages and novel features of the invention will become more apparent from the following detailed description when taken in conjunction with the accompanying drawings.

DETAILED DESCRIPTION OF THE INVENTION

Figure 1:
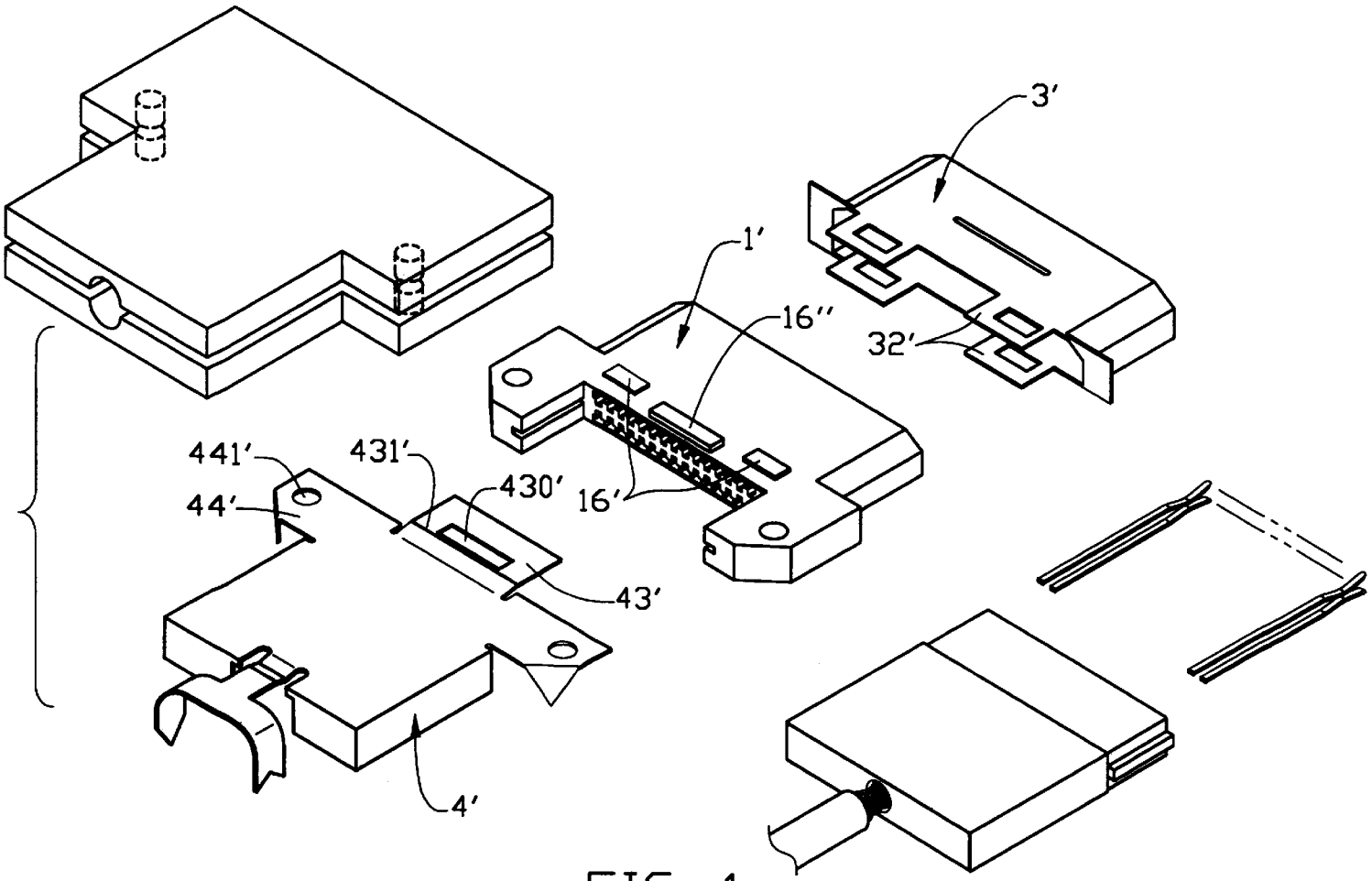
FIG. 1 (PRIOR ART)
FIG. 1 is an exploded view of a conventional cable connector.
Figure 2:
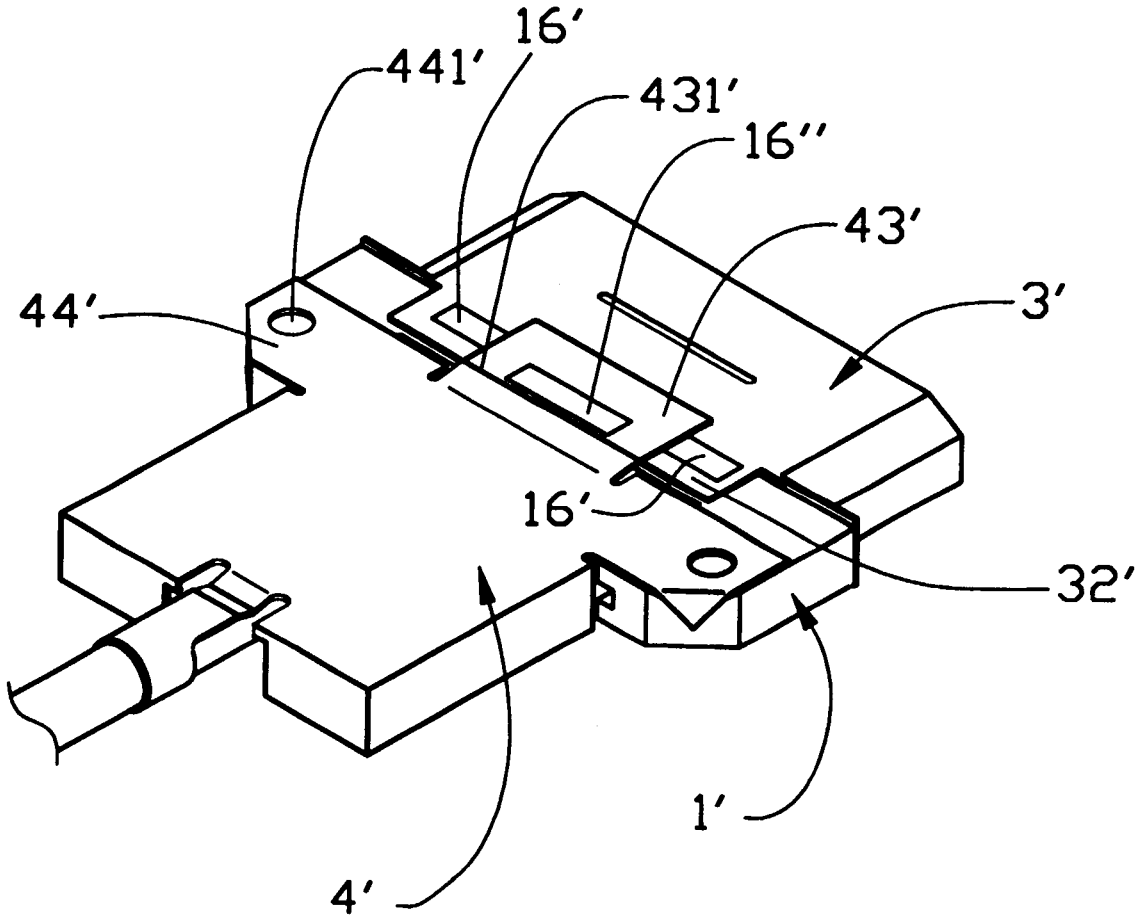
FIG. 2 (PRIOR ART)
FIG. 2 is an assembled view of FIG. 1.
Figure 3:
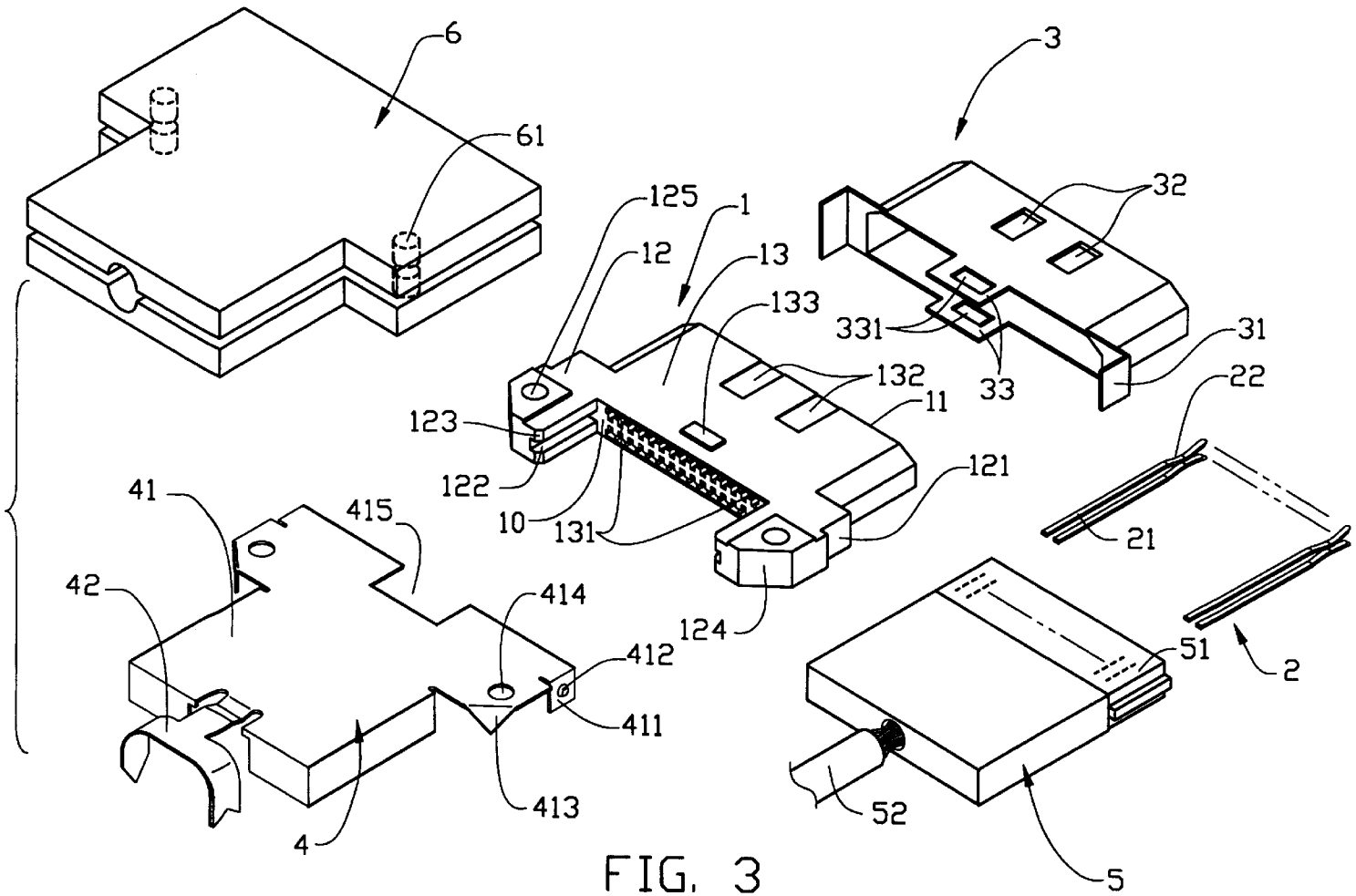
FIG. 3 is an exploded view of a cable connector in accordance with the present invention.

Referring to FIG. 3, a cable connector in accordance with the present invention comprises a dielectric housing 1 receiving a plurality of contacts 2 therein, a shielding mechanism including a first shell 3 and a second shell 4 for enclosing the housing 1 therein, a module 5 including a circuit board 51 for electrically connecting with the housing 1, and a dielectric jacket 6 for enclosing the cable connector. The housing 1 has a mating surface 11, a connecting surface 10, a base 13 between the mating surface 11 and the connecting surface 10, and a frame 12 outwardly extending from opposite sides of the connecting surface 11 in a longitudinal direction. The frame 12 is U-shaped and forms a pair of positioning portions 121 for engaging with the first and second shells 3, 4. A pair of guiding grooves 122 is defined in opposite inner side surfaces of the positioning portion 121 for guiding the circuit board 51 of the module 5 into the housing 1. A pair of first diagonal faces 123 is formed between end surfaces of the frame 12 and the inner side surfaces for facilitating engagement of the circuit board 51 of the module 5 with the housing 1. A pair of second diagonal faces 124 is formed between the end surfaces and outer side surfaces of the housing 1 for cooperating with the second shell 4. The frame 12 also defines a pair of through holes 125 proximate the end surfaces for cooperating with the second shell 4.

The base 13 defines a mating chamber (not shown) exposed to the mating surface 11 for insertion of a mating connector therein. Two rows of receiving slots 131 are defined between the mating surface 11 and the connecting surface 10 for receiving the corresponding contacts 2. Two engaging notches 132 are defined proximate the mating surface 11 on upper and lower surfaces of the base 13. A projection 133 is formed on the upper surface of the base 13 proximate the connecting surface 10. The projection 133 and the engaging notches 132 fix the first shell 3 with the base 13.

Each contact 2 comprises a soldering end 21 for being soldered to a mating circuit board and a mating end 22 received in the corresponding receiving slot 131 of the housing 1 for electrically connecting with the mating connector. The dielectric shell 6 forms a plurality of posts 61 for engaging with the housing 1 and the shielding mechanism. The contacts 2, the module 5 and the dielectric shell 6 do not exhibit any inventive characteristics. Therefore, a detailed description thereof is omitted herein.

The first shell 3 and the second shell 4 are formed and stamped from metal sheets. The first shell 3 encloses the base 3 and forms four engaging recesses 32 with a bottom surface for reception in the engaging notches 132 of the base 13. A pair of first grounding tabs 31 integrally extend from opposite sides of the first shell 3 and perpendicularly bent away from the engaging recesses 33. The positioning portions 121 further form a pair of step-like shoulders on opposite lateral sides thereof corresponding to the first and the second grounding tabs 31, 411 of the first and the second shells 3, 4. A pair of positioning tabs 33 extends from middle portions of the upper and lower surfaces of the first shell 3. Each grounding tab 33 defines a latching aperture 331 therein for engaging the corresponding projection 133 of the base 13.

The second shell 4 encloses the frame 12, and comprises a main body 41 and a clasping portion 42. A pair of second grounding tabs 411 integrally extends from opposite sides of the main body 41 away from the clasping portion 42. Each second grounding tab 411 is perpendicularly bent relative to the main body 41 and defines a dimple 412 outwardly projecting from the main body 41 for engaging with the corresponding first grounding tab of the first shell 3. The main body 41 of the second shell 4 further forms a pair of engaging tabs 413 corresponding to the second diagonal faces 124 of the frame 12 for abutting there against. The main body 41 also defines a pair of holes 414 corresponding to the through holes 125 of the frame 12, and a cutout 415 in a middle position of the main body 41 opposite the clasping portion 42 for permitting the corresponding grounding tabs 33 are positioned therein.

Figure 4:
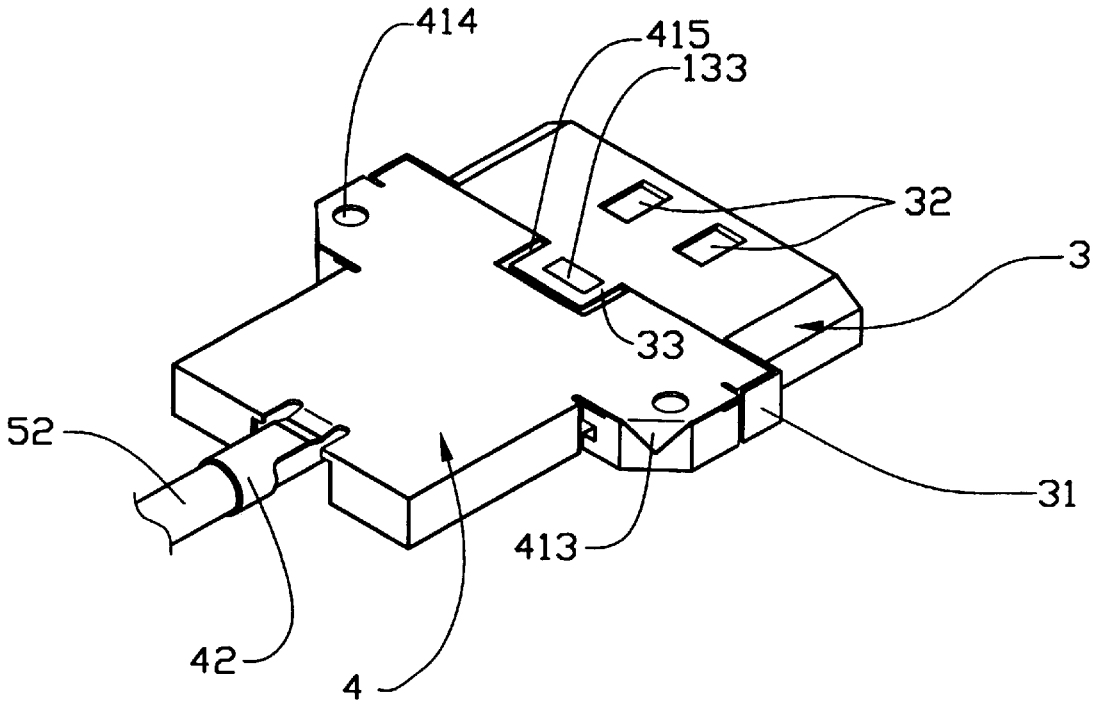
FIG. 4 is a partially-assembled view of FIG. 3.
Figure 5:
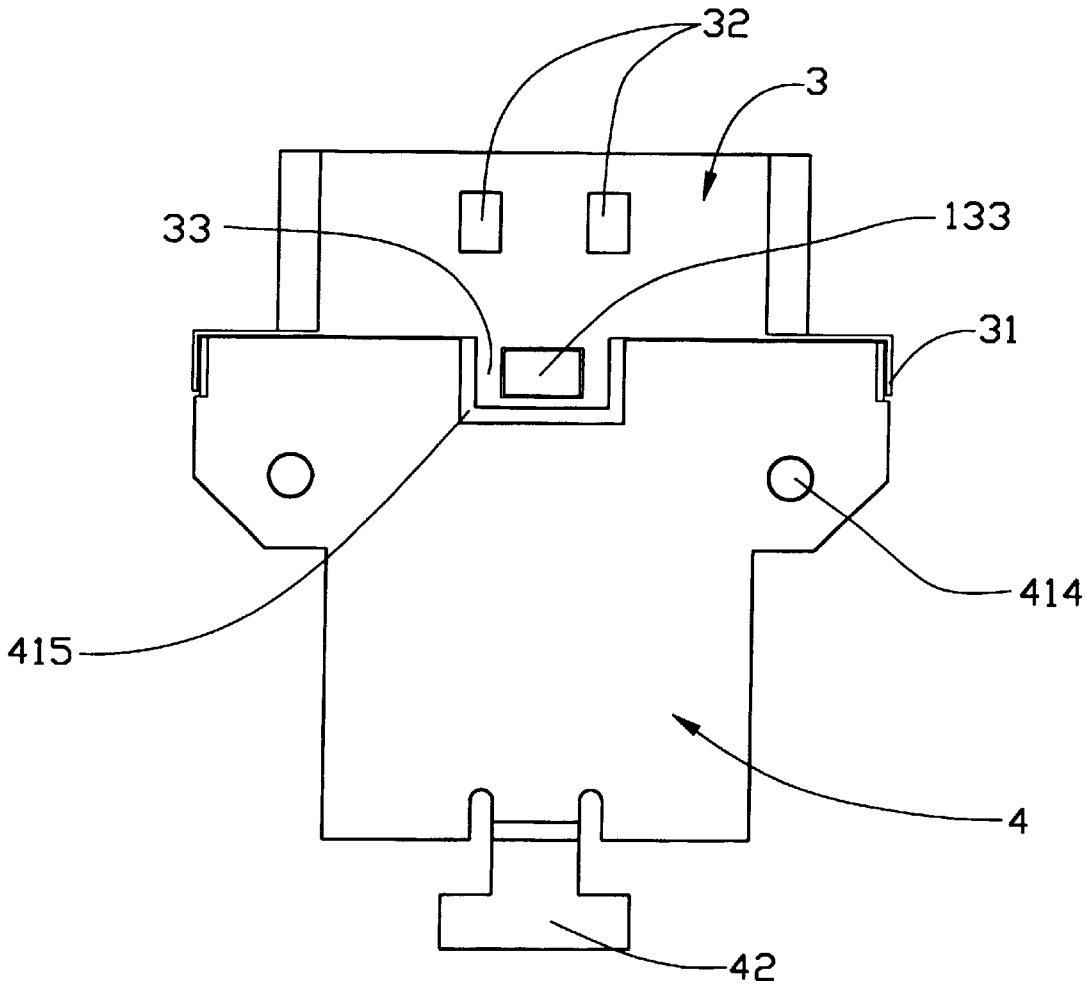
FIG. 5 is a top plan view of FIG. 3 after assembly.
Figure 6:
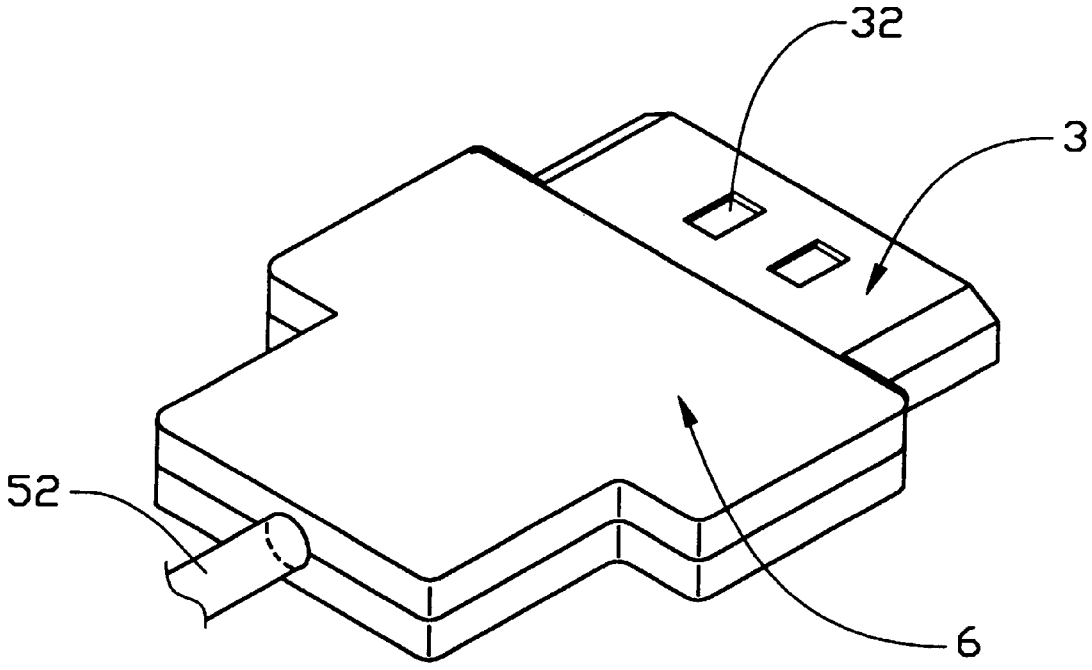
FIG. 6 is an assembled view of FIG. 3.

Also referring to FIGS. 4, 5, and 6, in assembly, the contacts 2 are first inserted into the housing 1 from the connecting surface 10. The mating ends 22 are located within the corresponding receiving slots 131, while the soldering ends 21 extend beyond the connecting surface 10 for electrically connecting with the module 5. The module 5 is then inserted into the frame 12 via the guiding grooves 122, and the soldering ends 21 of the contacts 2 are soldered to corresponding conductive pads (not shown) of the circuit board 51. Thus, the module 5 is firmly assembled to the housing 1.

The second shell 4 is positioned to enclose the frame 12 of the housing 1 and the module 5 therein. The clasping portion 42 of the second shell 4 surrounds the cable 52 of the module 5. The engaging tabs 413 abut against the corresponding second diagonal faces 124, while the second grounding tabs 411 abut against the corresponding positioning portions 121. The holes 414 align with the corresponding through holes 125 of the frame 1.

The first shell 3 is then fixed to the base 13 of the housing. The engaging recesses 32 are received in the corresponding engaging notches 132, while the latching apertures 331 of the positioning tabs 33 engage with the corresponding projections 133. The first grounding tabs 31 abut against the corresponding second grounding tabs 411, while the dimples 412 simultaneously abut against the corresponding first grounding tabs. Thus, a grounding path is formed through grounding wires of the cable 52, the second shell 4, the first shell 3, and a shield of the mating connector for electrostatic discharge therethrough. Thus, a subassembly is formed after the first and second shells 3, 4 commonly enclose the housing 1 with the module 5 assembled therein.

The dielectric shell 6 is then fixed to enclose the subassembly with the posts 61 being inserted in the corresponding through holes 125 of the housing 1 and the corresponding holes 414 of the second shell 4.

Therefore, an integral cable connector is assembled exhibiting advantages of excellent shielding effects and reliable application performance. In particular, the shielding mechanism of the present invention can prevent the grounding path described above become open or break off, since the first and second shell 3, 4 will not disengage from each other during a bend test or practical application. Moreover, the second shell will not buckle at middle portions due to arrangements of the second grounding tabs 411 and the middle cutouts 415 thereby permitting the dielectric shell 6 to be properly insert molded around the subassembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

a dielectric housing receiving a plurality of contacts therein and having a mating surface, a connecting surface, and a pair of positioning portions each outwardly extending from opposite lateral sides thereof proximate the connecting surface;

a module comprising a circuit board fixed between the positioning portions for electrically connecting with the contacts and a shielded cable, the shielded cable being connected to the circuit board and comprising a grounding wire;

a shielding mechanism comprising a first shell forming a positioning tab extending from a middle portion thereof, and a second shell defining a cutout in an edge of a middle portion thereof corresponding to the positioning tab of the first shell, the first and second shells respectively having a pair of first and a pair of second grounding tabs for engaging with the positioning portions of the dielectric housing, the first grounding tabs electrically contacting the corresponding second grounding tabs thereby ensuring the continuity of a grounding path formed through the grounding wire of the cable, the first grounding tabs of the first shell and the second grounding tabs of the second shell, the first shell and the second shell commonly enclosing the dielectric housing and the module therein; and a dielectric jacket enclosing the first shell and the second shell.

2. The cable connector as claimed in claim 1, wherein a pair of step-like shoulders is formed on opposite lateral sides of the positioning portions of the dielectric housing corresponding to the first and second grounding tabs of the first and second shells.

3. The cable connector as claimed in claim 2, wherein each second grounding tab extends from each lateral side of the second shell, and inner surfaces of the second grounding tabs abut against outer surfaces of corresponding shoulders of the positioning portion.

4. The cable connector as claimed in claim 2, wherein each second grounding tab defines an outwardly projecting dimple thereon, and the first grounding tabs of the first shell extend from opposite lateral sides of the first shell and overlap on corresponding second grounding tabs of the second shell to abut against corresponding dimples of the second grounding tabs and form a grounding path via the grounding wire of the cable and the first and second shells.

5. The cable connector as claimed in claim 1, wherein the dielectric housing forms a pair of diagonal faces on opposite lateral sides of corresponding shoulders, and the second shell forms a pair of engaging tabs extending from opposite lateral sides thereof proximate the second in positioning tabs for abutting against the corresponding diagonal faces of the shoulders of the dielectric housing.

* * * * *